United States Patent [19]

Chapman

[11] Patent Number: 4,643,361

[45] Date of Patent: Feb. 17, 1987

[54] ANTI-CORROSION COMPOSITION FOR USE IN BALL MILLS

[76] Inventor: Terrence R. Chapman, #135-3280 E. 58th Ave., Vancouver, B.C., Canada, V5S 3T2

[21] Appl. No.: 661,681

[22] Filed: Oct. 17, 1984

[30] Foreign Application Priority Data

Oct. 20, 1983 [CA] Canada ..... 439417

[51] Int. Cl.[4] ..... B02C 23/18

[52] U.S. Cl. ..... 241/16; 241/20; 241/21; 241/22

[58] Field of Search ..... 241/16, 20, 21, 170, 241/184, 22; 423/166

[56] References Cited

U.S. PATENT DOCUMENTS 3,318,538 5/1967 Needham ..... 241/184 X
4,402,923 9/1983 Lang ..... 423/166

OTHER PUBLICATIONS

Revised by Gessner G. Hawley, "The Condensed Chemical Dictionary", 10th ed., 1981, pp. 13, 14 and 111.

*Primary Examiner*—Howard N. Goldberg
*Assistant Examiner*—Timothy V. Eley

[57] ABSTRACT

In a method of operating a ball or rod mill that comprises milling substrate with an attrition medium in the presence of an aqueous carrier. An anti-corrosion composition comprising a water soluble, (alkali metal) phosphate and a water soluble zinc salt is maintained in the aqueous carrier.

8 Claims, No Drawings

ANTI-CORROSION COMPOSITION FOR USE IN BALL MILLS

This invention relates to a method of improving the operation of an attrition mill.

An attrition mill is used to grind a substrate, typically an ore, to reduce the particle size of the substrate. The mill contains an attrition medium which acts as the grinding medium to reduce the size of the particles of the substrate. For example, the attrition medium is a plurality of balls in a ball mill and a plurality of rods in a rod mill.

In an attrition mill the loss of attrition medium is remarkably high. The function of the attrition medium is, of course, to grind down the ore but, inevitably, certain attrition of the attrition medium takes place. Considerable force is involved so that impaction of the medium both with themselves and with the ore provides significant loss. This is documented as attrition from erosion. A further significant loss is corrosion, which has been documented in the literature over the past decade.

The present invention seeks to reduce the loss of attrition medium through corrosion in an attrition mill.

Accordingly, the present invention is a method of operating an attrition mill that comprises milling substrate with an attrition medium in the presence of an aqueous carrier, and is the improvement that comprises maintaining in an aqueous carrier for the ore, an anti-corrosion composition comprising a water soluble, (alkali metal) phosphate and a water soluble zinc salt.

In a preferred embodiment the phosphate is a metaphosphate and the alkali metal is a sodium or potassium. The zinc salt may desirably be zinc chloride, a zinc salt that is easily obtainable and is water soluble. In a further preferred embodiment the attrition media are soaked in an aqueous solution of the above anti-corrosion composition prior to being introduced into the attrition mill.

The method was developed to ensure:

1. The net grinding cost must be significantly reduced.

2. No major increase in equipment or operating expenses should be incurred. Indeed it is an advantage of the invention that the only change required in the mill operation is the controlled addition of two aqueous solutions.

3. The process must not create problems in subsequent mill circuits.

4. The pH in the attrition mill must remain substantially unaffected upon the addition of the anti-corrosion agent. Therefore, the pH is maintained in a range of 7 to 9.

The invention is illustrated in the following results achieved in tests, carried out in an attrition mill of Brenda Mines Ltd., near Peachland in the interior of British Columbia. The mill was grinding copper ore mined at the mine. The test was conducted for approximately 240 days with a break at the mid-point due to plant shut-down. For reporting purposes the test results are labelled Part I and Part II.

The test log for Part I is listed in Table 1.

TABLE I

| TRIAL DAY | CIRCUIT 1 HRS. | CT1-CHEMICAL FEED RATES-cc/min ROD SOL 1 | ROD SOL 2 | BALL SOL 1 | BALL SOL 2 | RESIDUAL CHEMICAL LEVELS-ppm ROD | BALL | CT1 WKLY AVG IN TONS PER HOUR | RATIO-CT1 TO 3&4 | CT1 MEDIUM ADTN RODS ADDED | BALL (BUCKETS) | CT1 POWER DRAW-KW ROD | BALL |
|---|---|---|---|---|---|---|---|---|---|---|---|---|---|
| 0 | 24 | | | | | | | | | 15 | 1 | 1165.2 | 1784.4 |
| 1 | 24 | | | | | | | 316.1 | 1.043 | | 1 | 1168.3 | 1179.1 |
| 2 | 23.7 | | | | | | | | | 15 | 1 | 1163.8 | 1775.0 |
| 3 | 23.6 | 16 | 7 | 45 | 0 | 0 | 0 | | | | 1 | 1152.3 | 1766.5 |
| 4 | 23.7 | 25 | 0 | 45 | 10.5 | 0 | 0 | | | 15 | 1 | 1133.7 | 1753.9 |
| 5 | 24 | 0 | 12.5 | 45 | 12.5 | 0 | 0 | | | | 1 | 1130.3 | 1751.5 |
| 6 | 23.8 | | | | | | | | | 15 | 1 | 1121.3 | 1738.5 |
| 7 | 24 | | | | | | | | | | 1 | 1121.6 | 1746.8 |
| 8 | 23.7 | | | | | | | 293.0 | 0.984 | 15 | 1 | 1115.4 | 1736.5 |
| 9 | 23.7 | 15 | 8 | 41 | 16 | 0 | 0 | | | | 1 | 1104.7 | 1742.4 |
| 10 | 23.7 | 16 | 6 | 41 | 14 | 0.1 | 0.1 | | | 15 | 1 | 1081.2 | 1732.1 |
| 11 | 24 | 14.5 | 6 | 41 | 14 | 0.1 | 0.1 | | | | 1 | 1088.8 | 1690.6 |
| 12 | 23.8 | 14.5 | 8 | 40 | 20 | | | | | 15 | 1 | 1073.6 | 1713.8 |
| 13 | 23.2 | 20 | 9 | 56 | 24 | 0 | 0 | | | 20 | 2 | 1116.4 | 1706.3 |
| 14 | 23 | | | | | | | | | 20 | 1 | 1161.4 | 1705.3 |
| 15 | 24 | | | | | | | 312.4 | 1.047 | | 2 | 1143.9 | 1708.3 |
| 16 | 23.8 | 19.5 | 12 | 57 | 26 | 0 | 0 | | | 20 | 3 | 1125.3 | 1715.4 |
| 17 | 23.8 | 21 | 8 | 55 | 24 | 0.1 | 0.34 | | | | 2 | 1133.3 | 1743.1 |
| 18 | 19.3 | — | — | — | — | — | — | | | 20 | 2 | 1124.7 | 1758.6 |
| 19 | 24 | 22 | 10 | 54 | 25 | 0.27 | 0.07 | | | | 2 | 1133.8 | 1747.8 |
| 20 | 23.7 | | | | | | | | | 18 | 1 | 1142.0 | 1765.1 |
| 21 | 24 | | | | | | | | | | 1 | 1153.0 | 1757.8 |
| 22 | 23.8 | | | | | | | 305.7 | 1.005 | 18 | 2 | 1127.6 | 1756.7 |
| 23 | 23.5 | 22 | 10 | 56 | 23 | 0.1 | 0.28 | | | | 1 | 1118.4 | 1757.4 |
| 24 | 23.4 | 20 | 10.5 | 54 | 23 | 0.1 | 0.32 | | | 18 | 1 | 1120.6 | 1772.1 |
| 25 | 24 | 20 | 10 | 58 | 23 | | | | | | 1 | 1139.9 | 1770.2 |
| 26 | 23.7 | 26 | 13 | 53 | 23 | 0.1 | 0.25 | | | 18 | 2 | 1124.9 | 1778.4 |
| 27 | 19.3 | 25 | 13.5 | 58 | 24 | — | — | | | | 1 | 1119.7 | 1789.3 |
| 28 | 23.8 | | | | | | | | | 18 | 2 | 1099.5 | 1780.5 |
| 29 | 24 | | | | | | | 282.8 | 0.981 | | 1 | 1122.8 | 1784.9 |
| 30 | 23.3 | 24 | 14 | 57 | 24 | 0.14 | 0.39 | | | 18 | 1 | 1113.8 | 1774.8 |
| 31 | 24 | 24 | 11.5 | 59 | 23 | 0.1 | 0.1 | | | | 1 | 1103.6 | 1768.7 |
| 32 | 23.7 | 25 | 12 | 59 | 23 | 0.1 | 0.1 | | | 30 | 1 | 1084.7 | 1765.4 |
| 33 | 6.2 | 26 | 12 | 59 | 25 | 0.1 | 0.1 | | | | | 1156.9 | 1765.5 |
| 34 | 20 | 27 | 14 | 59 | 25 | 0.1 | 0.1 | | | | 1 | 1171.0 | 1776.9 |
| 35 | 24 | | | | | | | | | 15 | 1 | 1173.0 | 1761.6 |
| 36 | 21.8 | | | | | | | 284.2 | 1.026 | | 1 | 1141.9 | 1760.1 |
| 37 | 21.5 | 25 | 13 | 59 | 26 | 0.1 | 0.1 | | | 15 | 1 | 1125.6 | 1771.8 |
| 38 | 0 | — | — | — | — | — | — | | | | | — | — |
| 39 | 19.5 | 27 | 14 | 59 | 27 | | | | | 30 | 2 | 1185.3 | 1782.8 |
| 40 | 23.9 | 24 | 14 | 59 | 26 | 0.15 | 0.1 | | | 21 | 2 | 1189.9 | 1791.8 |
| 41 | 24 | ROD MILL | | 59 | 27 | | 0.26 | | | | 2 | 1179.9 | 1804.4 |
| 42 | 16.8 | CHEMICAL | | | | | | | | 20 | 1 | 1185.3 | 1819.0 |
| 43 | 24 | FEED OFF | | | | | | 287.1 | 0.929 | | 1 | 1196.2 | 1800.5 |
| 44 | 23.9 | | | 59 | 26 | | 0.13 | | | 20 | 1 | 1200.6 | 1795.5 |
| 45 | 24 | | | 59 | 26 | | 0.16 | | | | 1 | 1208.5 | 1804.9 |
| 46 | 15.4 | | | 59 | 27 | | 0.1 | | | 20 | 1 | 1199.5 | 1806.1 |
| 47 | 24 | | | 60 | 26 | | 0.11 | | | | 1 | 1191.2 | 1793.4 |
| 48 | 23.9 | | | 60 | 26 | | 0.12 | | | 20 | 1 | 1189.7 | 1783.5 |

TABLE I-continued

| TRIAL DAY | CIRCUIT 1 HRS. | CT1-CHEMICAL FEED RATES-cc/min ROD SOL 1 | ROD SOL 2 | BALL SOL 1 | BALL SOL 2 | RESIDUAL CHEMICAL LEVELS-ppm ROD | BALL | CT1 WKLY AVG IN TONS PER HOUR | RATIO-CT1 TO 3&4 | CT1 MEDIUM ADTN RODS ADDED | BALL (BUCKETS) | CT1 POWER DRAW-KW ROD | BALL |
|---|---|---|---|---|---|---|---|---|---|---|---|---|---|
| 49 | 24 | | | | | | | | | | 1 | 1190.9 | 1768.7 |
| 50 | 23.9 | | | | | | | 302.9 | 0.994 | 20 | 1 | 1187.7 | 1770.6 |
| 51 | 23.8 | | | 60 | 26 | | 0.10 | | | | 1 | 1201.7 | 1772.8 |
| 52 | 22.1 | | | 60 | 26 | | 0.06 | | | 20 | 1 | 1198.8 | 1764.5 |
| 53 | 24 | | | 60 | 27 | | 0.02 | | | | 1 | 1206.6 | 1757.5 |
| 54 | 23.9 | | | 60 | 26.5 | | 0.1 | | | 20 | 1 | 1187.4 | 1771.7 |
| 55 | 24 | | | | | | | | | | 1 | 1203.9 | 1753.7 |
| 56 | 23.9 | | | | | | | | | 20 | 1 | 1188.3 | 1738.7 |
| 57 | 24 | | | | | | | 305.7 | 1.012 | | 2 | 1195.2 | 1741.7 |
| 58 | 23.9 | | | 60 | 27 | | | | | 20 | 1 | 1183.2 | 1737.6 |
| 59 | 24 | | | 60 | 27 | | | | | | 2 | 1186.4 | 1759.6 |
| 60 | 23.2 | | | 60 | 27 | | | | | 20 | 1 | 1175.5 | 1757.9 |
| 61 | 24 | | | 60 | 26 | | | | | | 2 | 1175.1 | 1759.3 |
| 62 | 23.9 | | | 59 | 26 | | | | | 20 | 1 | 1166.5 | 1738.6 |
| 63 | 24 | | | | | | | | | | 2 | 1169.9 | 1745.3 |
| 64 | 23.9 | | | | | | | 293.8 | 0.987 | 20 | 1 | 1158.5 | 1739.5 |
| 65 | 24 | | | | | | | | | | 2 | 1184.2 | 1747.8 |
| 66 | 23.9 | | | 60 | 27 | | | | | 20 | 1 | 1164.5 | 1731.2 |
| 67 | 24 | | | 60 | 27 | | | | | | 1 | 1169.1 | 1739.3 |
| 68 | 20.4 | | | 60 | 26 | | | | | 20 | 2 | 1164.4 | 1742.0 |
| 69 | 23.1 | | | 60 | 27 | | | | | | 1 | 1181.8 | 1752.7 |
| 70 | 23.9 | | | | | | | | | 20 | 2 | 1162.3 | 1762.9 |
| 71 | 24 | | | | | | | 317.4 | 1.022 | | 2 | 1172.7 | 1766.9 |
| 72 | 23.9 | | | 60 | 27 | | " | | | 20 | 1 | 1165.3 | 1753.2 |
| 73 | 24 | | | 62 | 27 | | 0.14 | | | | 2 | 1162.7 | 1762.7 |
| 74 | 23.4 | | | 60 | 27 | | | | | 20 | 1 | 1169.3 | 1759.4 |
| 75 | 10.6 | | | — | — | | — | | | | 1 | 1163.2 | 1672.8 |
| 76 | 23.9 | | | | | | 0.1 | | | 20 | 2 | 1192.8 | 1684.7 |
| 77 | 24 | | | | | | | | | | 2 | 1197.3 | 1683.3 |
| 78 | 23.5 | | | | | | | 331.2 | 1.014 | 20 | 1 | 1181.0 | 1684.0 |
| 79 | 24 | | | 60 | 27 | | | | | | 2 | 1197.5 | 1169.5 |
| 80 | 23.9 | | | 60 | 27 | | | | | 20 | 3 | 1192.1 | 1728.0 |
| 81 | 24 | | | 60 | 25 | | | | | | 2 | 1206.9 | 1726.0 |
| 82 | 23.9 | | | | | | | | | 20 | 1 | 1209.4 | 1712.8 |
| 83 | 24 | | | 60 | 27 | | " | | | | 3 | 1214.1 | 1721.9 |
| 84 | 20.7 | | | | | | | | | 20 | 1 | 1189.5 | 1710.6 |
| 85 | 24 | | | | | | | 330.7 | 1.064 | | 2 | 1204.2 | 1719.0 |
| 86 | 23.9 | | | 60 | 25 | | | | | 20 | 1 | 1198.7 | 1731.2 |
| 87 | 24 | | | 62 | 29 | | | | | | 2 | 1213.5 | 1741.1 |
| 88 | 23.9 | | | 62 | 27 | | 0.17 | | | 20 | 1 | 1202.3 | 1756.9 |
| 89 | 24 | | | 65 | 28 | | 0.1 | | | | 2 | 1211.5 | 1762.4 |
| 90 | 23.8 | | | 58 | 27 | | " | | | 20 | 1 | 1204.9 | 1758.5 |
| 91 | 24 | | | | | | | | | | 2 | 1291.4 | 1758.1 |
| 92 | 23.9 | | | | | | | 308.4 | 1.053 | 20 | 1 | 1213.9 | 1767.2 |
| 93 | 24 | | | 60 | 27 | | | | | | 1 | 1225.2 | 1766.1 |
| 94 | 23.9 | | | 62 | 25 | | | | | 20 | 1 | 1221.01 | 1761.9 |
| 95 | 24 | | | 61 | 26 | | | | | | 2 | 1221.0 | 1738.4 |
| 96 | 23.9 | | | 60 | 26 | | | | | 20 | 1 | 1215.0 | 1743.3 |
| 97 | 24 | | | | | | | | | | 2 | 1221.5 | 1765.9 |

TABLE I-continued

| TRIAL DAY | CIRCUIT 1 HRS. | CT1-CHEMICAL FEED RATES-cc/min ROD SOL 1 | ROD SOL 2 | BALL SOL 1 | BALL SOL 2 | RESIDUAL CHEMICAL LEVELS-ppm ROD | BALL | CT1 WKLY AVG IN TONS PER HOUR | RATIO-CT1 TO 3&4 | CT1 MEDIUM ADTN RODS ADDED | BALL (BUCKETS) | CT1 POWER DRAW-KW ROD | BALL |
|---|---|---|---|---|---|---|---|---|---|---|---|---|---|
| 98 | 23.9 | | | | | | | | | 20 | 1 | 1208.9 | 1763.5 |
| 99 | 24 | | | | | | | 316.3 | 1.071 | | 1 | 1213.6 | 1748.7 |
| 100 | 23.4 | | | 60 | 26 | | 0.1 | | | 20 | 1 | 1202.4 | 1735.8 |
| 101 | 16.9 | | | — | — | | — | | | | 2 | 1191.4 | 1792.2 |
| 102 | 23.9 | | | 60 | 25 | | 0.1 | | | 20 | 1 | 1187.7 | 1782.2 |
| 103 | 24 | | | | | | " | | | | 1 | 1228.5 | 1755.4 |
| 104 | 23.9 | | | | | | | | | 20 | 1 | 1197.0 | 1788.6 |
| 105 | 24 | | | | | | | | | | 2 | 1207.9 | 1713.9 |
| 106 | 23.9 | | | | | | | 311.4 | 1.026 | 20 | 1 | 1208.7 | 1748.8 |
| 107 | 24 | | | 60 | 28 | | 0.12 | | | | 2 | | |
| 108 | 23.9 | | | 60 | 27 | | 0.1 | | | 20 | 1 | | |
| 109 | 24 | | | 60 | 27 | | | | | | 1 | | |
| 110 | 23.9 | | | 61 | 26 | | | | | 20 | 1 | | |
| 111 | 24 | | | 59 | 25 | | | | | | 1 | | |
| 112 | 23.9 | | | | | | | | | 20 | 1 | | |
| 113 | 24 | | | | | | | 315.0 | 1.031 | | 2 | | |
| 114 | 23.8 | | | 61 | 26 | | | | | 20 | 1 | | |
| 115 | 24 | | | 58 | 25 | | | | | | 1 | | |
| 116 | 23.9 | | | 58 | 25 | | | | | 20 | 1 | | |
| 117 | 24 | | | 58 | 24 | | | | | | 2 | | |
| 118 | 23.9 | | | 57 | 26 | | | | | 20 | 1 | | |
| 119 | 24 | | | | | | | | | | 2 | | |

In the above Table headings CT1 is circuit 1, number one grinding circuit in the mill.
Sol 1 is solution 1 a solution having the composition 440 Kg of sodium hexa metaphosphate and 18 Kg of sodium tripolyphosphate in 1000 liters of aqueous solution.
Sol 2 is a solution of 317 Kg of zinc chloride in 1000 liters of aqueous solution.
A bucket of ball mill balls is 3,200 lbs.
The addition of corrosion inhibitor to the rod mill was discontinued on day 41 as no reduction of rod mill steel consumption had been observed. This was agreed on by both Brenda Mines and the inventor.

TABLE II

CIRCUIT #1 WEEKLY GRINDING BALL CONSUMPTION[1] IN PART I OF TEST

| DAY NO. | OPERATING HR. | BUCKETS OF GRINDING BALLS ADDED | BALL CONSUMPTION[2] KG/HR. | % REDUCTION[3] VS. BASELINE CONSUMPTION |
|---|---|---|---|---|
| Days 1–8 | 190.1 | 8 | 66.75 | 34.6 |
| Day 9–15 | 165.4 | 9 | 86.31 | 15.5 |
| Day 16–22 | 162.4 | 13 | 126.98 | −24.0 |
| Day 23–29 | 161.7 | 9 | 88.29 | 13.5 |
| Day 30–36 | 143.0 | 6 | 66.55 | 34.8 |
| Day 37–43 | 129.7 | 10 | 122.29 | −11.0 |
| Day 44–50 | 159.1 | 7 | 69.78 | 31.6 |
| Day 51–57 | 165.7 | 8 | 76.59 | 25.0 |
| Day 58–64 | 166.9 | 10 | 95.04 | 6.9 |
| Day 65–71 | 163.3 | 11 | 106.85 | −4.7 |
| Day 72–78 | 153.3 | 10 | 103.47 | −1.3 |
| Day 70–85 | 164.5 | 14 | 135.00 | −32.2 |
| Day 86–92 | 167.5 | 10 | 94.70 | 7.2 |
| Day 93–99 | 167.7 | 9 | 85.13 | 16.6 |
| Day 100–106 | 160.0 | 9 | 89.22 | 12.6 |
| Day 107–113 | 167.6 | 9 | 85.13 | 16.6 |
| Day 114–119 | 167.5 | 9 | 85.23 | 16.5 |
| Total: | 2755.5 | Tot: 161 | Avg: 92.7 | Avg. 9.2 |

[1]Data from Brenda Mines computer printout

[2]Calculated from $\frac{(3200^{\#}/\text{Bucket} \times 1.093 \times 1000\text{KG/MT})\text{Buckets}}{2205^{\#}/\text{MT}}$ Note: 1.093 is long-term inventory adjustment factor; KG/MT = kilograms/metric ton.

[3]Baseline consumption of 102.1 KG/HR is average grinding ball consumption for this mill for 6-month period preceding test.

SUMMARY OF RESULTS OF PART I OF CORROSION INHIBITOR TEST

1. The addition of corrosion inhibitor to the ball mill continued for 120 days. The addition rate of corrosion inhibitor was increased on day 13 from the original dosage of 19 ml/min for the zinc chloride solution and 45 ml/min of the phosphate solution to 25 and 60 respectively. The composition of the two solutions was changed to a new composition by the inventor on day 55. The original composition was reimplemented on day 93. The two solutions are compared in Table III below.

2. The total addition of balls to #1 ball mill was 161 buckets during Part I.

$$\text{Weight of balls consumed} = 161 \text{ buckets} \times 3200 \text{ lb/bucket} \times 1.093$$

$$= 563{,}113.6 \text{ lb}$$

$$= 255{,}380.0 \text{ kg}$$

During the test period #1 grinding circuit operated for 2756 hours.

$$\text{Hourly steel consumption} = 255{,}380 \text{ kg}/2756 \text{ hours}$$

$$= 92.66 \text{ kg/hour}$$

3. During the six months prior to the test, 269 buckets of steel were added to #1 ball mill. #1 Grinding circuit operated for 4179.8 hours in this time interval.

$$\text{Weight of balls consumed} = 269 \times 3200 \times 1.093/2.205$$

$$= 426{,}691.3 \text{ kg}$$

$$\text{Hourly steel consumption} = 426{,}692 \text{ kg}/4179.8 \text{ hours}$$

-continued $$= 102.1 \text{ kg/hour}$$

TABLE III

PERFORMANCE COMPARISON BETWEEN 2 FORMULATIONS USED IN PART I

| TEST DAY NOS. | % REDUCTION IN GRINDING BALL CONSUMPTION FROM BASELINE | AVG REDUCTION |
|---|---|---|
| ORIGINAL COMPOSITION | | |
| Days 1–8 | 34.6 | |
| Days 9–15 | 15.5 | |
| Days 16–22 | −24.4 | |
| Days 23–29 | 13.5 | |
| Days 30–36 | 34.8 | |
| Days 37–43 | −11.0 | |
| Days 44–50 | 31.6 | |
| Days 51–57 | 25.0 | |
| Days 93–99 | 16.6 | |
| Days 100–106 | 12.6 | |
| Days 107–113 | 16.6 | |
| Days 114–119 | 16.5 | 14.5 |
| NEW COMPOSITION | | |
| Days 58–64 | 6.9 | |
| Days 65–71 | −4.7 | |
| Days 72–78 | −1.3 | |
| Days 79–85 | −32.2 | |
| Days 86–92 | 7.2 | −4.8 |

The trial was continued in Part II for a further 122 days.

The results were:

1. Total ball addition and operating time as per operator reports:

| Time - Days | Buckets | Op. Hours |
|---|---|---|
| 1–20 | 28 | 498.19 |
| 21–52 | 42 | 739.15 |
| 53–83 | 42 | 708.54 |
| 84–115 | 39 | 713.30 |
| 116–126 | 14 | 263.65 |
| Total | 165 | 2912.83 |

2. Media consumption rate.

Weight of balls consumed:

$$165 \text{ buckets} \times 3200 \frac{\text{Lb}}{\text{bucket}} \times 1.093 = 577{,}104 \text{ Lb.}$$

$$= 261{,}725 \text{ Kg}$$

$$= 89.85 \text{ Kg/Hr}$$

Comments on the complete test will start with a summary of the results:

| | PART I | PART II |
|---|---|---|
| Test Duration | 119 days | 123 days |
| Baseline Grinding Ball Consumption | 102.1 Kg/Hr | 102.1 Kg/Hr |
| Test Grinding Ball | 92.7 Kg/Hr | 89.9 Kg/Hr |

-continued

| | PART I | PART II |
|---|---|---|
| Consumption Reduction From Baseline Consumption | 9.4% | 12.0% |

1. Because of the variables involved in the operation of the mill there is a large short-term fluctuation in grinding media consumption. Statistical analysis of mill data for approximately four years prior to the test indicates that for an approximately 8 month test (240 days) a 6.5% reduction in grinding ball consumption is the threshold for statistical significance. That is, any reduction greater than 6.5% cannot be attributed to chance but results from, in this case, the successful application of the corrosion inhibition process.

2. During Part I of the test the inhibitor formulation was changed in an unsuccessful attempt to improve performance. For 12 of the 17 weeks of Part I, the "original" formulation reduced grinding ball consumption by an average 14.6%—see Table II above.

3. During most of Part II the inhibitor feed rates were inadvertantly set at only 73% of the feed rates of Part I. This was felt to impair performance. Additionally however the grinding balls were presoaked in a dilute aqueous solution of the corrosion inhibitors. This was felt to provide an initial protection and is now considered an important part of the corrosion inhibition process.

4. Based on the test results and comments on 2. and 3. a long-term reduction in grinding ball consumption of 15% would be a realistic goal at this mill.

5. In economic terms this plant would realize a considerable advantage from employing the process on a full-plant (4 grinding mills) scale:

| Approximate annual cost of grinding balls: $2,300,000 | |
|---|---|
| Reduction in costs based on a 15% reduction in grinding ball consumption: | $344,000 |
| Annual cost of corrosion inhibitor chemicals | $92,000 |
| Net savings in grinding costs | $252,000 |

The embodiments of the invention in which an exclusive property or privilege is claimed are defined as follows:

1. A method of milling substrate comprising the step of milling said substrate in an attrition mill containing therein grinding media, an aqueous carrier, and an anti-corrosion composition, said anti-corrosion composition comprising a water soluble phosphate salt and a water soluble zinc salt, while maintaining the pH in the range of 7 to 9.

2. A method as claimed in claim 1 in which the phosphate is a meta phosphate or a polyphosphate.

3. A method as claimed in claim 1 in which the phosphate salt is a sodium or potassium salt.

4. A method as claimed in claim 1 in which the phosphate metal phosphate is selected from sodium tripolyphosphate and sodium hexametaphosphate.

5. A method as claimed in claim 1 in which the zinc salt is zinc chloride.

6. A method as claimed in claim 1 in which the attrition mill is a ball mill.

7. A method as claimed in claim 1 in which the attrition mill is a rod mill.

8. A method as described in claim 1 in which the attrition medium is soaked in an aqueous solution of the anti-corrosion composition prior to being placed in the attrition mill.

* * * * *

UNITED STATES PATENT AND TRADEMARK OFFICE

CERTIFICATE OF CORRECTION

PATENT NO. : 4,643,361

DATED : February 17, 1987

INVENTOR(S) : Chapman

It is certified that error appears in the above-identified patent and that said Letters Patent is hereby corrected as shown below:

Column 12, Claim 4 should read as follows:

-- 4. A method as claimed in claim 1 in which the phosphate salt is selected from sodium tripolyphosphate and sodium hexametaphosphate. --.

Signed and Sealed this

Fifth Day of September, 1989

*Attest:*

*Attesting Officer*

DONALD J. QUIGG

*Commissioner of Patents and Trademarks*